United States Patent [19]

Cain

[11] Patent Number: 4,944,702

[45] Date of Patent: Jul. 31, 1990

[54] HOUSING RUDDER FOR ELECTRIC TROLLING MOTOR

[75] Inventor: Alan Cain, Fort Worth, Tex.

[73] Assignee: Shark-fin Products, Inc., Arlington, Tex.

[21] Appl. No.: 339,225

[22] Filed: Apr. 17, 1989

[51] Int. Cl.[5] ..... B63H 21/26

[52] U.S. Cl. ..... 440/51; 440/6; 440/78

[58] Field of Search ..... 440/6, 51, 71, 72, 76, 440/78, 900, 113; 114/146, 152, 162, 164, 165, 168

[56] References Cited

U.S. PATENT DOCUMENTS

| | | | |
|---|---|---|---|
| 3,035,538 | 5/1962 | Willard | 440/72 |
| 3,285,219 | 11/1966 | Linsley | 440/51 |
| 3,687,101 | 8/1972 | Linsley | 440/51 |
| 3,939,795 | 2/1976 | Rocka | 440/78 |
| 3,991,700 | 11/1976 | Cleary et al. | 440/51 |
| 4,013,033 | 3/1977 | Porter et al. | 440/72 |
| 4,129,088 | 12/1978 | Foley, Jr. | 440/6 |
| 4,290,760 | 9/1981 | Liudblad | 440/51 |
| 4,382,796 | 5/1983 | Blanchard | 440/51 |
| 4,634,388 | 1/1987 | Covell | 440/51 |

*Primary Examiner*—Joseph F. Peters, Jr.
*Assistant Examiner*—Edwin L. Swinehart
*Attorney, Agent, or Firm*—James E. Bradley

[57] ABSTRACT

A device is provided for attachment to the submerged portion of an electric trolling motor to serve as a rudder and to further provide quieter operation and resistance to fouling by aquatic vegetation. The device, which may be of integral or two piece construction, attaches to the vertically disposed control shaft of the trolling motor and further embraces the drive unit of the motor. An upper section of the device has opposed side walls of large area, thereby providing a rudder effect.

5 Claims, 2 Drawing Sheets

HOUSING RUDDER FOR ELECTRIC TROLLING MOTOR

BACKGROUND OF THE INVENTION

This invention relates to rudders, and more particularly concerns rudder means for use with electric trolling motors.

Electric trolling outboard motors are in widespread use, particularly on small boats designed for fishing on island or other relatively calm waters. The low speeds and quiet operation of the trolling motors minimize disturbance of the fish in the waters being fished.

Most electric trolling motors are provided with a smooth, circular shaft connecting the submerged drive motor and propeller assembly with batteries and control means aboard the boat. In contrast, gasoline operated outboard motors are generally provided with an elongated, streamlined housing contoured to function as a rudder. At trolling speeds, an electric motor, when suitably rotated about a vertical axis provides a steering effect ordinarily provided by a rudder. However, at very slow speeds, or when the motor is not running, the boat cannot be steered by positioning movement of the motor. A guard vane or blade, sometimes referred to as a "skag", is generally positioned beneath the electric motor forwardly of the propeller for the purpose of protecting the propeller from impact with hard objects. Such protecting vanes, however, provide little, if any steering effect.

In earlier efforts to impart better steering function to outboard motors, rudder-like panels have been affixed to the motor shaft. U.S. Pat. No. 4,634,388 discloses the attachment of a rudder panel to the shaft of an electric trolling motor at a site above the motor/propeller assembly. Although effective in principle, the stability of the attachment relative to rotative displacement about the shaft is questionable. Furthermore, the space created between the rudder and the motor/propeller assembly impairs streamlining characteristics and serves to catch and accumulate vegetation often encountered at fishing locations.

It is accordingly an object of the present invention to provide a rudder which may be easily and securely attached to an electric trolling motor.

It is another object of this invention to provide a rudder as in the foregoing object which provides a streamlined effect and avoids accumulation of aquatic vegetation.

It is a further object of the invention to provide a rudder of the aforesaid nature which additionally serves to reduce the level of sound emitted from the motor.

It is a still further object of this invention to provide a rudder of the aforesaid nature of rugged, durable design and amenable to low cost manufacture.

These objects and other objects and advantages of the invention will be apparent from the following description.

SUMMARY OF THE INVENTION

The above and other beneficial objects and advantages are accomplished in accordance with the present invention by a housing device adapted to embrace the drive unit, guard vane, and a portion of the shaft of an electric trolling motor.

The housing device may be characterized as having:

(a) a vertical plane of symmetry, (b) an upper section whose maximum thickness, measured transversely to said plane of symmetry, is just slightly greater than the shaft upon which the housing is mounted, (c) a middle section contoured to closely embrace the drive unit, and (d) a lower section whose thickness is generally smaller than said upper section, and contoured to closely embrace the guard vane downwardly directed from the underside of the drive unit, or to function as such guard vane.

The housing device may be fabricated from impact-resistant plastic or metals by a molding operation. In preferred embodiments, the housing device is of monolithic construction, having forward and bottom edges which are sealed, and a trailing edge which may be pryed open sufficiently to permit emplacement of the device upon the trolling motor. The housing device is an enclosed structure except for a first circular aperture at the top of the upper section which engages the shaft of the motor, and a second circular aperture at the rearward extremity of the middle section for engaging the drive unit.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
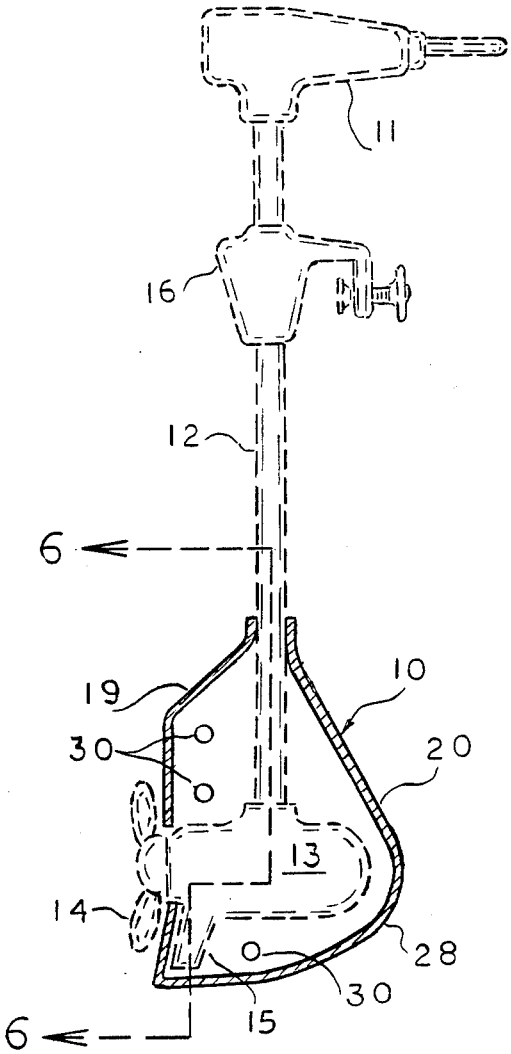
FIG. 1 is a side view of an embodiment of the housing device shown in functional engagement with an electric trolling motor.
Figure 6:
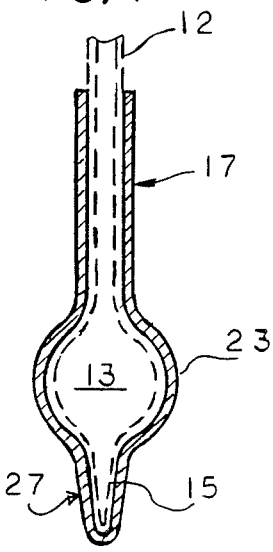
FIG. 6 is a sectional view taken upon the line 6-6 of FIG. 1.
Figure 2:
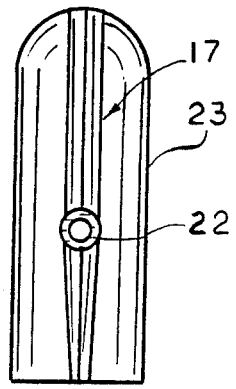
FIG. 2 is an enlarged top view of the device of FIG. 1.

Referring to FIG. 1, an embodiment 10 of the rudder device of this invention is shown emplaced upon an electric trolling outboard motor comprised of control means 11, shaft 12, motor drive unit 13 disposed at the lowermost extremity of shaft 12, propeller 14 disposed at the rear of drive unit 13, propeller guard 15 downwardly directed from the underside of drive unit 13, and clamping means 16 for attaching the motor to a boat.

As shown more clearly in FIGS. 2–6, the exemplified rudder housing device is of monolithic construction, fabricated of a metal or thermoplastic polymer by a molding operation. Suitable polymers include high impact ABS (acrylonitrile-butadiene-styrene), nylons, polycarbonates, polyacetals, polyesters and other polymers of equivalent strength and durability.

The device has an upper section 17 whose maximum thickness, measured transversely to plane of symmetry 18, is just slightly greater than the diameter of shaft 12. Said upper section is bounded by two opposed panels 21 which meet in a closed, forwardly curved leading edge 20, and a trailing edge 19 where the two opposite panels are resiliently separable. A first circular aperture 22 is disposed atop upper section 17, and is intended to make a snap-fitting engagement with shaft 12. Said first aperture is positioned substantially midway between the extremities of the leading and trailing edges of upper section 17. In other embodiments, the first aperture may be differently located. If the housing device serves as the primary encasement for the drive unit, said first aperture would not be present.

The opposed panels are further contoured to form a middle section 23 contoured to closely embrace the drive unit 13 of the trolling motor. The leading extremity 24 of the middle section is closed in the form of a streamlined nose cane. The trailing extremity 25 has a second circular aperture 26 which permits insertion of the drive unit into the rudder device.

A lower section 27 is additionally formed by said opposed panels as a continuous integral extension of the bottom of middle section 23. Said lower section is bounded by a sealed bottom edge 28 having a smoothly curved shape extending between the forward and rearward extremities of middle section 23. The lower section is further bounded by an open trailing edge 29 which is substantially in vertical alignment with trailing edge 19 of upper section 17. Said lower section is further configured to firmly enclasp propeller guard vane 15. The overall thickness of the lower section, measured transversely to the plane of symmetry, is smaller than the correspondingly measured thickness of the upper section.

Figure 3:
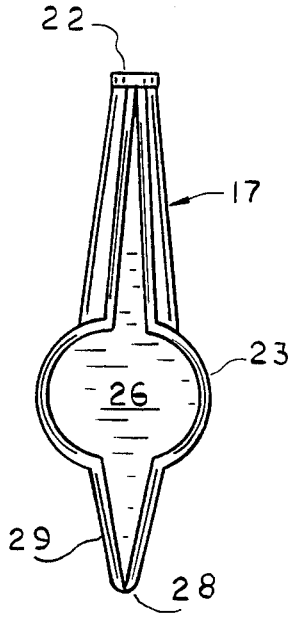
FIG. 3 is a rear view showing the device in a transiently pulled apart state.
Figure 4:
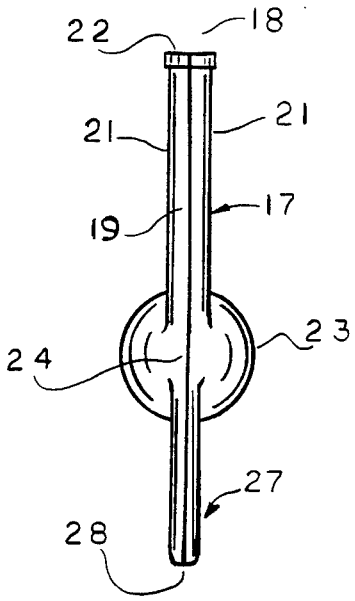
FIGS. 4 and 5 are, respectively, front and bottom views of the device of FIG. 1.
Figure 5:
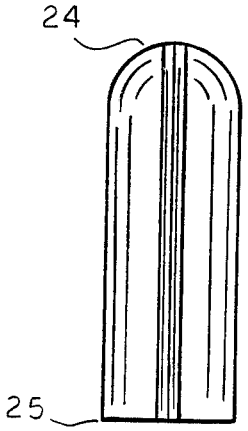

By virtue of the specialized structure and properties of the exemplified monolithic embodiment of the rudder device, it can be easily and securely applied onto the trolling motor by pulling apart opposed panels 21 adjacent the trailing edges of the several sections. Such transiently pulled apart state is shown in FIG. 3. Once the pulled-apart device is forced onto the drive unit and shaft of the trolling motor, it snaps closed to securely enclasp the trolling motor. Rotational movement about the motor shaft is prevented because of the interaction of the housing device with the drive unit and propeller guard vane. In some instances, bolts can be inserted through the opposed panels at pre-formed depressions 30.

Because of the manner in which the rudder housing device encloses the drive unit, there is less likelihood of accumulating aquatic vegetation. The side surface area of opposing panels 21 provides excellent rudder function. Other features such as a transducer, and temperature, oxygen and pH sensors can also be enclosed within the rudder housing. The housing allows for materials to be used that reduce the transmission of noise from the motor into the water.

In one method of fabrication, two halves, representing opposed panels 21 may be brought together and sealed along the leading edge of the upper section, nose extremity of the middle, and bottom edge of the lower section. In another manner of fabrication, the housing device may be molded as an integral unit, and then the trailing edge extremities may be cut open to facilitate forceful separation of the opposed panels at said trailing edges.

The housing and rudder design can be the primary encasement of the power unit. The hydrodynamics of the surfaces of the housing device may be such as to more effectively channel water to the propeller. Horizontal stabilizer fins may also be added to the housing.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In an electric trolling motor of a type having a drive unit and a cylindrical control shaft, a housing device enclosing the drive unit comprising in combination:

(a) a vertical plane of symmetry, (b) an upper section having top and bottom extremities and opposed sidewalls of large area, the control shaft extending upward from the upper section, the upper section having a leading edge which extends forward of the control shaft and inclines downward at an angle relative to the axis of the control shaft, the upper section having a trailing edge located rearward of the control shaft and extending downward, the distance from the lowermost portion of the trailing edge of the upper section to the lowermost portion of the leading edge of the upper section being substantially greater than the diameter of the control shaft, (c) a middle section emergent from the bottom extremity of said upper section and closely embracing the drive unit, and (d) a lower section whose thickness is generally smaller than the thickness of said middle section, and contoured as a guard vane downwardly directed from the underside of said middle section.

2. The device of claim 1 fabricated of impact-resistant material by a molding operation.

3. A housing device adapted to embrace the drive unit, guard vane, and a portion of a cylindrical control shaft of an electric trolling motor, said device being characterized as having:

(a) a vertical plane of symmetry, (b) an upper section having top and bottom extremities and opposed sidewalls of large area, the maximum thickness of said upper section measured transversely to said plane of symmetry being just slightly greater than the diameter of the control shaft embraced by the device, (c) a middle section emergent from the bottom extremity of said upper section and contoured to closely embrace the drive unit, (d) a lower section whose thickness is generally smaller than the thickness of said upper section, and contoured as a guard vane downwardly directed from the underside of said middle section, the device being fabricated of impact-resistant material by a molding operation, and the device being of monolithic construction, having forward and bottom edges which are sealed, and a trailing edge which may be pried open sufficiently to permit emplacement of the device upon the trolling motor.

4. A housing device adapted to embrace the drive unit, guard vane, and a portion of a cylindrical control shaft of an electric trolling motor, said device being characterized as having:

(a) a vertical plane of symmetry, (b) an upper section having top and bottom extremities and opposed sidewalls of large area, the maximum thickness of said upper section measured transversely to said plane of symmetry being just slightly greater than the diameter of the control shaft embraced by the device, (c) a middle section emergent from the bottom extremity of said upper section and contoured to closely embrace the drive unit, (d) a lower section whose thickness is generally smaller than the thickness of said upper section, and contoured as a guard vane downwardly directed from the underside of said middle section, the device being fabricated of impact-resistant material by a molding operation, the device being of monolithic construction, having forward and bottom edges which are sealed, and a trailing edge which may be pried open sufficiently to permit emplacement of the device upon the trolling motor, and the device having an enclosed configuration except for a first circular aperture at the top of the upper section to accommodate the control shaft of the motor, and a second circular aperture at the trailing edge of the middle section for accommodating a propeller shaft horizontally emergent from said drive unit.

5. In a trolling motor of a type having a drive unit and a cylindrical control shaft extending upward from the drive unit, a housing device for embracing the drive unit and a portion of the control shaft, comprising in combination:

(a) a vertical plane of symmetry, (b) an upper section having top and bottom extremities and opposed sidewalls, the control shaft extending upward from the upper section, the upper section having a leading edge which extends forward of the control shaft, the upper section having a trailing edge that extends rearward from the control shaft, the distance from the lowermost portion of the trailing edge of the upper section to the lowermost portion of the leading edge of the upper section being substantially greater than the diameter of the control shaft, (c) a middle section emergent from the bottom extremity of said upper section and closely embracing the drive unit, the middle section having an aperture for accommodating a propeller shaft horizontally emergent from said drive unit, the middle section having a leading edge which joins the leading edge of the upper section and extends downward therefrom, the middle section having a thickness that is generally greater than the thickness of the upper section, (d) a lower section whose thickness is generally smaller than the thickness of said middle section, and contoured as a guard vane downwardly directed from the underside of said middle section, the lower section having a leading edge which joins the leading edge of the middle section and extends downward therefrom, the lower section having a trailing edge which extends downward from the aperture of the middle section, the lower section having a bottom edge, and (e) the device being of monolithic construction, with the leading edges of the upper section, middle section, and lower section being sealed and the bottom edge of the lower section being sealed, the trailing edges of the upper section and lower section being expansible apart sufficiently to receive the control shaft and motor for emplacement of the device on the trolling motor.

* * * * *